United States Patent [19]
Ulry et al.
[11] 4,451,264
[45] May 29, 1984

[54] SURFACE COLORING OF POLYVINYL RESINS

[75] Inventors: Donald C. Ulry; Charles G. Cosner; Thomas D. Ryan, all of Escondido, Calif.

[73] Assignee: Formulabs Industrial Inks, Inc., Escondido, Calif.

[21] Appl. No.: 424,058

[22] Filed: Sep. 27, 1982

[51] Int. Cl.³ ..... D06P 5/00
[52] U.S. Cl. ..... 8/508; 8/614; 8/615; 8/679; 8/938
[58] Field of Search ..... 8/508, 614, 938, 615, 8/679

[56] References Cited

U.S. PATENT DOCUMENTS

| | | | |
|---|---|---|---|
| 2,635,942 | 4/1953 | Thummel | 8/508 |
| 3,081,140 | 3/1963 | Ford | 8/508 |
| 3,741,720 | 6/1973 | Hederich et al. | 8/614 |
| 3,830,626 | 8/1974 | Rosenberger et al. | 8/508 |
| 3,845,081 | 10/1974 | Kienzle et al. | 8/678 |
| 3,909,442 | 9/1975 | Tucker et al. | 524/90 |
| 4,014,647 | 3/1977 | Neeff | 8/614 |
| 4,015,934 | 4/1977 | Liechti et al. | 8/614 |
| 4,081,240 | 3/1978 | Datye et al. | 8/614 |

FOREIGN PATENT DOCUMENTS 50-07870 1/1975 Japan .

OTHER PUBLICATIONS

Venkataraman's "The Chemistry of Synthetic Dyes," vol. VIII (Academic Press) 1978 pp. 81–85, 109–115.

*Primary Examiner*—A. Lionel Clingman
*Attorney, Agent, or Firm*—Sellers and Brace

[57] ABSTRACT

This invention is directed to inks (coloring solutions) for polyvinyl resin surfaces, particularly PVC wire insulation color coding, where the ink consists essentially of a Color Index Solvent dye dissolved in a liquid halogenated hydrocarbon solvent having 1–2 carbon atoms. A preferred solvent is dichloromethane.

8 Claims, No Drawings

SURFACE COLORING OF POLYVINYL RESINS

BACKGROUND OF THE INVENTION

1. Field of the Invention

This invention relates to coloring surface area(s) of polyvinyl resins. More particularly, this invention relates to coloring surface area(s) of water insoluble, organic solvent resistant, electrical insulator polyvinyl resins by way of a nonflammable halogenated hydrocarbon solvent solution of a Colour Index solvent dye.

2. Description of the Prior Art

U.S. Pat. No. 3,741,720, granted June 26, 1973, filed Oct. 12, 1970, is directed to dyeing of certain synthetic fiber materials, namely, polyesters, cellulose triacetate, polyamides, polyurethanes and polyolefins. Illustrative given materials are: polyethylene terephthalate, Nylon, and polypropylene. The dye solution comprises a certain anthraquinone and a water immiscible, organic solvent boiling between 40°–150° C. Preferred solvents are halogenated hydrocarbons, such as, chloromethanes, chloro alkanes and chloroalkenes having 2–5 carbon atoms, chlorofluoroalkanes and alkenes having 2–5 carbon atoms and fluoroalkanes. The particularly preferred solvents are tetrachloroethylene, trichloroethylene, 1,1,1-trichloroethane, and 1,1,1-trichloropropane. The anthraquinone dye is limited to:

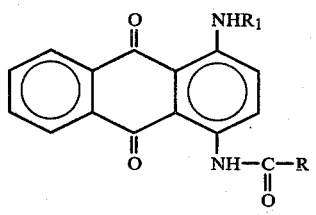

where R may be $C_1$-$C_{17}$ alkyl, aralkyl, or substitued aryl and $R_1$ may be alkyl, alkylalkoxy, alkylalkamine, cycloalkyl, aralkyl or substituted aryl, the $R+R_1$ carbon atoms are 5–35 in number. After the impregnation with the dye liquor, the fiber material is subjected to a heat treatment, which may consist of a brief dry-heat treatment at 120°–230° C., to fix the dye on the fiber.

In the surface coloring of polyvinyl resins, especially the surface of electrical wire insulation, the dye solution has comprised an oxygenated organic solvent, such as a ketone or alcohol and a soluble dye. Unfortunately, these solvents are flammable with low flash and fire points and create dangerous fire hazards in the use of these dye solutions.

SUMMARY OF THE INVENTION

The invention herein concerns a process for coloring a surface area of a water insoluble, organic solvent resistant, electrical insulator polyvinyl resin by contacting said surface with a dye solution consisting essentially of a liquid halogenated hydrocarbon solvent having 1–2 carbon atoms, where halogen is chlorine, fluorine or both, and Colour Index solvent dye dissolved in said solvent. The contacting is for a time sufficient to color said surface area, and then removing residual solvent from said colored surface area. Desirably, the liquid solvent is a chloromethane or mixture thereof. Preferably, the chloromethane is dichloromethane (methylene chloride). Desirably, the Colour Index dye is selected from the class consisting of anthraquinone, azine, azo, phthalocyanine, triarylmethane, diphenymethane, styryl and xanthene. Preferably the anthraquinone dye is 1,4-bis(alkylamino)anthraquinone where alkyl has 1–6 carbon atoms or 1,4-bis(R-amino)anthraquinone where R is alkyl having 1–6 carbon atoms or aryl. Desirably the polyvinyl resin is selected from the class consisting of: polyvinyl chloride, polyvinyl dichloride, polyvinyl fluoride, polyvinyl acetate, polyvinyl propionate, polyvinyl butyrate, polyvinyl acetal, polyvinyl butyral, polyvinyl formal, polyvinylidene chloride, polyvinylidene fluoride; the copolymers of vinyl chloride, vinyl fluoride, vinyl acetate, vinyl propionate, vinyl butyrate, vinylidene chloride, vinylidene fluoride, acrylate and acrylonitrile monomers; and graft polymers of polyvinyl chloride, polyvinyl acetate, polyvinylidene chloride with ethylene vinyl acetate or ethylene propylene diene monomers. Preferably, the polyvinyl resin is selected from the group consisting of: polyvinyl chloride, polyvinyl dichloride, polyvinyl fluouride, polyvinyl(chloride-acetate), poly(vinylchloride-vinylidene chloride), and poly(vinyl chloride-methylmethacrylate).

An example of the invention is a process for coloring a surface area of a polyvinyl chloride electrical wire insulation which process comprise:contacting a surface of said insulator with a nonflammable liquid solution of dichloromethane solvent, 98.33 weight percent; Ciba Geigy Solvent Yellow 48 dye, 1.10 weight percent; and Ciba Geigy Solvent Red 125 dye, 0.57 weight percent; for a time sufficient to color said surface area; and removing residual solvent from said colored surface area.

The inks (dye solutions) used in the process of this invention are non-flammable as opposed to acetone, the normal solvent of choice; can be packaged in plastic containers as opposed to the more expensive metal containers used for the prior art inks; can be air freighted non-restricted; importantly can be applied to PVC surfaces at a faster rate (higher wire speeds) because of the faster drying rate, with no change in equipment.

DETAILED DESCRIPTION

Polyvinyl Resins

The polyvinyl resins to whose surface coloring the invention is directed are essentially water insoluble, resistant (at least in bulk configuration, such as wire coating) to solution in organic solvents, and suitable for use as electrical insulators. These polyvinyl resins may be homopolymers, copolymers or graft polymers.

More specifically suitable homopolymers, in an nonexclusive listing,: polyvinyl chloride, the chlorine enriched polyvinyl dichloride, polyvinyl fluoride, polyvinyl acetate, polyvinyl propionate, polyvinyl butyrate, polyvinyl acetal, polyvinyl butyral, polyvinyl formal, polyvinylidene chloride, and polyvinylidene fluoride. Preferred homopolymers are polyvinyl chloride, polyvinyl dichloride, polyvinyl fluoride.

Suitable copolymers may be made by the reaction of two or more of the following monomers, in a nonexclusive listing: vinyl chloride, vinyl fluoride, vinyl acetate, vinyl propionate, vinyl butyrate; vinylidene chloride (1,1-dichloroethylene), vinylidene fluoride, the various acrylate monomers, and the various acrylonitrile monomers. It is preferred that the acrylate and acrylonitrile monomers be reacted with one or more of the aforesaid named vinyl or vinylidene monomers. Illustrations of these are: vinyl chloride or vinyl acetate and methylmethacrylate; vinylidene chloride and acrylonitrile or methacrylate. Preferred copolymers are polyvinyl(- chloride-acetate); poly(vinylchloride-vinylidene chloride); and poly(vinyl chloridemethylmethacrylate).

Illustrative suitable graft polymers are: the the polymer obtained by grafting a monomer, such as, ethylene vinyl acetate monomer or ethylene propylene diene monomer with one of polyvinyl chloride, polyvinyl acetate, polyvinylidene chloride or one of the copolymers of the vinyl chloride, vinyl acetate, and vinylidene chloride monomers.

It is to be understood that the aforesaid defined polyvinyl resins may be used in the rigid or flexible forms by compounding with plasticizer(s), stabilizer(s), filler(s), colorants, etc. These defined polyvinyl resins are available in one or more of the following: film, sheet, fiber, foam and granules.

Halogenated Solvent

The liquid, nonflammable, halogenated dye solvent of the invention is a halogenated hydrocarbon having 1–2 carbon atoms where halogen is chlorine, fluorine, or both are present. For example: chloromethane, dichloromethane (methylene chloride), chloroform, carbon tertrachloride, 1,1-dichloroethane, 1,2-dichloroethane, 1,1,1-trichloroethane, 1,1,2-trichloroethane, 1,1,2,2-tetrachloroethane, 1,1,1-dichlorofluoro-2,2,2-dichlorofluoroethane, 1,1,1-trichloro-2,2,2-trifluoroethane. The liquid chloromethanes, especially dichloromethane, are the preferred dye solvents.

Dichloromethane (methylene chloride) is a nonflammable, clear, colorless, volatile liquid having a boiling point of 39.8° C. (103.6° F.); specific gravity of 1.320; solubility in water at 20° C., 13.2 g/kg; and no flash or fire point. Chloroform (trichloromethane) is a nonflammable, heavy, water-white, volatile liquid having a boiling point of 61.3° C. (142.3° F.) and no flash or fire point. Carbon tetrachloride is a heavy, nonflammable, colorless liquid having a boiling point of 76.7° C. (170.1° F.) with no flash or fire point.

Coloring Agents (Dyes)

The coloring agents suitable for use in the invention are those classified in the Colour Index application class "Solvent Dyes" plus some other water immiscible dyes that are soluble in the defined dye solvent. Following the Trade practice, dyes are identified by trade name and/or Colour Index class color and number, except that to clarify things some what the name of the supplier is prefixed. To illustrate: BASF Soluble Black BB or BASF Solvent Black 3. The Colour Index number, when it exists, is also given in the Table I.

The aforesaid coloring agents fall into one of the following chemical classes of dyes: anthraquinone, azine, azo, phthalocyanine, triarylmethane, diphenylmethane, styryl, and xanthene.

The more desirable solvent anthraquinone dyes are 1,4-bis(alkylamino)anthraquinone where alkyl has 1–6 carbon atoms and 1,4-bis(R-amino)anthraquinone where R is alkyl having 1–6 carbon atoms or aryl.

Four dyes with Trade accepted identification are set out for purposes of illustration.

1. 2,3-dihydro-2,2-dimethylperimidine
   Supplier: BASF
   Trade Name: Soluble Black BB
   Colour Index: Solvent Black 3
   Colour Index Number: 26,150
   Chemical Class: Disazo
2. 1,4-bis(isopropylamino)anthraquinone
   Supplier: DuPont
   Trade Name: Oil Blue A
   Colour Index: Solvent Blue 36
   Colour Index Number: 61,551
   Chemical Class: Anthraquinone
3. Chrome complex of Anthranilic acid/3-methyl-1-phenyl-5-pyrazolone
   Supplier: BASF
   Trade Name: Neozapon Yellow R
   Colour Index: Solvent Yellow 82
   Chemical Class: Azo
4. Trade Name: Nigrosine Base EE
   (Classical Name): Nigrosine Spirit Soluble
   Supplier: Orient Chemical Company
   Colour Index: Solvent Black 7
   Colour Index Number: 50415:1
   Chemical Class: Azine A partial listing of commercially available suitable dyes is set out in Table I.

TABLE I

| Dye Trade Name | Colour Index Name | CI Number | Chemical Class |
|---|---|---|---|
| A. American Cyanamid: Supplier | | | |
| Calco Oil Blue FLP | Solvent Blue 89 | 74340 | Phthalocyanine |
| B. Atlantic: Supplier | | | |
| Polycran Yellow 5R | Disperse Yellow 23 | 26070 | Disazo |
| C. BASF: Supplier | | | |
| Neozapon Yellow 157 | Solvent Yellow 82 | 18690 | Monoazo(Metal Complex) |
| Neozapon Black X51 | Solvent Black 27 | 12196 | Azo(1:2 Chrome) |
| Oil Soluble Blue 11 | Solvent Blue 35 | 61554 | Anthraquinone |
| Neozapon Yellow 081 | Solvent Yellow 79 | — | Azomethine |
| Neozapon Red 395 | Solvent Red 122 | 12716 | Azo(Chrome complex) |
| Sudan Deep Black BB | Solvent Black 3 | 26150 | Disazo |
| D. Ciba-Geigy; Supplier | | | |
| Orasol Yellow 2GLN | — | — | Azo(1:2 chrome complex) |
| Orasol Yellow 3GLG | Solvent Yellow 48 | — | Azo(metal complex) |
| Orasol Orange RLN | Solvent Orange 59 | — | Azo(metal complex) |

TABLE I-continued

| Dye Trade Name | Colour Index Name | CI Number | Chemical Class |
|---|---|---|---|
| Orasol Red G | Solvent Red 125 | — | Monoazo |
| Orasol Yellow 4GN | Solvent Yellow 146 | — | Monoazo |
| Orasol Yellow 4GN | Solvent Yellow 146 | — | Monoazo |
| Orasol Yellow | Solvent Yellow 48 | — | — |
| E. DuPont: Supplier | | | |
| Oil Blue A | Solvent Blue 36 | 61551 | Anthraquinone |
| F. Sandoz: Supplier | | | |
| Acetosol Brown GLS | Solvent Brown 28 | — | Azo(metalized) |
| Acetosol Red 3 BLS | Solvent Red 91 | — | Azo(metalized) |
| Acetosol Yellow RLS | Solvent Yellow 63 | — | Azo(metalized) |
| Acetosol Blue RLS | Solvent Blue 45 | — | Anthraquinone |
| Acetosol Blue GLS | Solvent Blue 44 | — | Phthalocyanine |
| Acetosol Yellow 5GLS | Solvent Yellow 138 | — | Styryl |
| Acetosol Red BLSN | Solvent Red 90-1 | — | Disazo |
| Acetosol Orange RLS | Solvent Orange 41 | — | Azo(metalized) |
| Acetosol Yellow 2RLS | Solvent Yellow 62 | — | Azo(metalized) |
| Acetosol Red BLS | Solvent Red 21 | — | Disazo |
| G. Orient Chemical Company: Supplier | | | |
| Nigrosine base EE | Solvent Black 7 | 50415 | Azine |

Utility

A protective film, sheet, or foamed film or sheet, of the desired polyvinyl resin may be applied to a suitable substrate, such as, an electrical conductor, typically by extrusion. Some of the polyvinyl resins may be applied to a substrate as an enamel from solution in a proper solvent. A preferred use for the process of this invention is to provide a color coding of pipes, conduits, and electrical insulation, such as by a solid color or by an encircling stripe or stripes.

EXAMPLES

Example 1

The prescribed amount of dichloromethane solvent, and the prescribed amount of each dye, was weighed into a mixing tank at room temperature, and were mixed, without any heating, until the dyes dissolved—1-5-20 minutes time.

White polyvinyl chloride electrical wire insulation was contacted with the ink by means of an immersion applicator to solid color the insulation. The ink was wiped from the insulation with a tight fitting silicone wiper. What residual solvent remains on the PVC surface quickly evaporates at room temperature. Post heating is not required.

The dry orange coloring was adherent to the PVC substrate and was capable of accepting the handling such electrical wiring gets in commerce without loss of any significant amount of the color. This colored insulation was suitable for commercial color coded usage.

The color solution (ink) used in this Example 1 was:

(i) Dichloromethane solvent: 98.33 weight %;
(ii) Ciba Geigy Orasol Yellow 3GLG (Solvent Yellow 48): 1.10 weight %;
(iii) Ciba Geigy Orasol Red G (Solvent Red 125): 0.57 weight %.

Example 2

A color solution formulation was made up as in Example 1, except the dichloromethane was replaced by 1,1,1-trichoroethane. This ink was used to solid color PVC electrical wire insulation as in Example 1.

It was observed that the trichloroethane solution did not migrate into the PVC insulation as quickly as did the dichloromethane solution—has less penetrating power. This is an important difference as in commercial usage the trichloroethane solution would require a longer time to obtain an equal quality colored product. If no adjustment is made for the lesser penetrating power the trichloroethane colored surface will not have the durability or color intensity (chroma) of the dichloromethane colored surface. However an acceptable colored surface was attained, herein.

Example 3

Coloring tests, as in Examples 1-2, demonstrated that the penetrating power with respect to PVC wire insulation is: chloromethanes, fastest; chloroethanes, noticeably slower; and chloropropanes, significantly inferior.

Examples 4-8

Five inks were prepared as in Example 1. Each ink was used to solid color code white PVC electrical wire insulation as in Example 1. Each ink produced commercially acceptable color coded insulation. The respective ink formulations are set out, as follows:

Example 4

A dark purple ink consisting of:

dichloromethane: 97.62 wt. %
Solvent Red 122: 1.66 wt %
Solvent Blue 35: 0.72 wt. %

Example 5

A yellow ink consisting of:

dichloromethane: 99.24 wt. %
Solvent Yellow 138: 0.21 wt. %
Solvent Yellow 62: 0.55 wt. %

Example 6

A green ink consisting of:

dichloromethane: 98.50 wt. %
Solvent Yellow 138: 1.00 wt. %
Solvent Blue 89: 0.50 wt. %

Example 7

A pink ink consisting of:

dichloromethane: 99.46 wt. %
Solvent Red 21: 0.54 wt. %

Example 8

A black ink consisting of:

dichloromethane 95.00 wt %
Solvent Black 3: 5.00 wt %

Thus having described the invention what is claimed is:

1. A process for the coloring of water insoluble, organic solvent resistant, electrical insulator polyvinyl resins which process comprises:

(A) contacting a surface area of said polyvinyl resin with a liquid, nonflammable, halogenated hydrocarbon solvent having 1–2 carbon atoms where halogen is chlorine, fluorine or both, and a solvent dye dissolved in said solvent;

(B) at about room temperature for a time sufficient to color said surface area; and (C) removing residual solvent from said surface area.

2. The process of claim 1 wherein said polyvinyl resin is selected from the class consisting of:

polyvinyl chloride, polyvinyl dichloride, polyvinyl fluoride, polyvinyl acetate, polyvinyl propionate, polyvinyl butyrate, polyvinyl acetal, polyvinyl butyral, polyvinyl formal, polyvinylidene chloride, polyvinylidene fluoride; the copolymers of vinyl chloride, vinyl fluoride, vinyl acetate, vinyl propionate, vinyl butyrate, vinylidene chloride, vinylidene fluoride, acrylate and acrylonitrile monomers; and graft polymers of polyvinyl chloride, polyvinyl acetate, polyvinylidene chloride with ethylene vinyl acetate or ethylene propylene diene monomers.

3. The process of claim 1 wherein said polyvinyl resin is selected from the group consisting of: polyvinyl chloride, polyvinyl dichloride, polyvinyl fluoride, polyvinyl(chloride-acetate), poly(vinylchloride-vinylidene chloride), and poly(vinyl chloride-methylmethacrylate).

4. The process of claim 1 wherein said chloromethane is dichloromethane.

5. The process of claim 1 wherein said solvent dye is selected from the class consisting of anthraquinone, azine, azo, phthalocyanine, triarylmethane, diphenylmethane, styryl, and xanthene.

6. The process of claim 6 wherein said anthraquinone dye is 1,4-bis(R-amino)anthraquinone where R is alkyl having 1–6 carbon atoms or aryl.

7. A process for the coloring of electrical insulator quality polyvinyl resins, which process comprises:

(A) contacting a surface area of said polyvinyl resin with an ink consisting of (a) dichloromethane solvent and (b) dye dissolved in said solvent;

(B) at about room temperature for a time sufficient to color said surface area; and (C) removing residual solvent from said surface area at about room temperature.

8. The process of claim 7 wherein said resin is polyvinyl chloride.

* * * * *